US010495290B1

(12) United States Patent
Genenbacher

(10) Patent No.: US 10,495,290 B1
(45) Date of Patent: Dec. 3, 2019

(54) ROOFING EDGE HANGER FOR DECORATIVE LIGHTS

(71) Applicant: Shawn Michael Genenbacher, Lubbock, TX (US)

(72) Inventor: Shawn Michael Genenbacher, Lubbock, TX (US)

( * ) Notice: Subject to any disclaimer, the term of this patent is extended or adjusted under 35 U.S.C. 154(b) by 0 days.

(21) Appl. No.: 15/991,314

(22) Filed: May 29, 2018

(51) Int. Cl.

| | |
|---|---|
| ***E04D 13/068*** | (2006.01) |
| ***F21V 21/088*** | (2006.01) |
| ***E04D 13/064*** | (2006.01) |
| *F21S 4/10* | (2016.01) |
| *E04D 13/15* | (2006.01) |
| *F21W 121/00* | (2006.01) |

(52) U.S. Cl.
CPC ..... *F21V 21/088* (2013.01); *E04D 13/064* (2013.01); *E04D 13/0685* (2013.01); *E04D 13/15* (2013.01); *F21S 4/10* (2016.01); *F21W 2121/004* (2013.01)

(58) Field of Classification Search
CPC ..... F21V 21/088; F21S 4/10; E04D 13/15; E04D 13/064; E04D 13/0685; F21W 2121/004
USPC .... 248/237, 231.3, 231.8, 48.1, 48.2; 52/11, 52/12, 15
See application file for complete search history.

(56) References Cited

U.S. PATENT DOCUMENTS 371,665 A * 10/1887 Brinkerhoff ..... A47G 1/16 248/489
672,701 A * 4/1901 Daniel ..... E04D 13/0722 248/48.1
1,327,770 A * 1/1920 Norton ..... E04D 13/15 52/96
1,782,246 A * 11/1930 Schneider ..... E04D 13/1415 52/60
1,855,241 A * 4/1932 Irwin ..... E04D 13/0725 248/48.2
2,271,081 A * 1/1942 Layton ..... E04D 13/076 210/474
2,636,458 A * 4/1953 Harris ..... E04D 13/076 160/369
3,181,827 A * 5/1965 Sassin ..... F16L 3/24 24/339
3,188,772 A * 6/1965 Tennison, Jr. ..... E04D 13/15 52/11

(Continued)

OTHER PUBLICATIONS

International Search Report and Written Opinion for PCT/US19/033453 dated Aug. 9, 2019, 8 pages.

*Primary Examiner* — Nkeisha Smith
(74) *Attorney, Agent, or Firm* — Vincent J. Allen; Carstens & Cahoon, LLP

(57) ABSTRACT

A roofing edge hanger for decorative lights is provided. The roofing edge hanger includes a substantially planar body adapted to lie flat against a roof, a support arm lying on a first plane that intersects a second plane at an angle, wherein the second plane is parallel to the body, wherein the support arm divides the body into a roof portion and a hook portion, wherein the support arm is attached to the body; and a plurality of hooks extending from the hook portion of the body, wherein the hooks are formed from a plurality of perforations of the body. The hanger is held in place between a roof and the shingles of the roof and provides a mounting surface and hooks for hanging up or mounting objects.

16 Claims, 4 Drawing Sheets

(56) References Cited

U.S. PATENT DOCUMENTS 3,193,229 A * 7/1965 Stock ..... F16L 3/24 24/339
3,333,803 A * 8/1967 Landis ..... E04D 13/072 248/48.2
3,341,158 A * 9/1967 Landis ..... E04D 13/0725 248/48.2
3,436,878 A * 4/1969 Singer ..... E04D 13/076 248/48.2
3,584,795 A 6/1971 Baird
3,752,428 A * 8/1973 Trostle ..... E04D 13/0725 248/48.2
3,864,882 A * 2/1975 Lasscock ..... E04D 13/0725 248/48.1
3,883,926 A 5/1975 Reynolds
4,043,527 A * 8/1977 Franzmeier ..... E04D 13/0725 219/213
4,218,857 A * 8/1980 Vallee ..... E04D 1/18 52/530
4,307,976 A * 12/1981 Butler ..... E04D 13/076 24/338
4,713,915 A * 12/1987 Sweers ..... E04D 13/0459 52/11
4,901,212 A 2/1990 Prickett
5,056,747 A 10/1991 Kireta
5,181,683 A 1/1993 Smith
5,271,192 A * 12/1993 Nothum, Sr. ..... E04D 13/076 248/48.2
5,414,965 A * 5/1995 Kelley ..... E04D 13/064 52/60
5,491,998 A 2/1996 Hansen
5,496,005 A 3/1996 Dieringer
5,581,956 A * 12/1996 Fennessy ..... F21V 21/088 248/237
5,707,136 A 1/1998 Byers
5,813,751 A 9/1998 Shaffer
5,966,875 A * 10/1999 Kuhns ..... E04D 13/076 52/12
6,035,587 A * 3/2000 Dressler ..... E04D 13/0459 52/716.2
6,161,338 A * 12/2000 Kuhns ..... E04D 13/076 210/474
6,182,933 B1 2/2001 Rapp
6,209,826 B1 * 4/2001 Pratt, Jr. ..... E04D 13/0725 248/231.9
6,935,074 B2 * 8/2005 Gramling ..... E04D 13/0722 248/48.1
7,066,618 B1 6/2006 Little
7,076,921 B2 * 7/2006 Spradlin ..... E04D 13/0641 248/48.1
7,104,011 B1 * 9/2006 Knight ..... E04D 13/076 52/11
7,104,013 B1 * 9/2006 Gates ..... E04D 13/158 52/60
7,188,977 B1 * 3/2007 Lough ..... F21V 21/088 362/249.14
7,726,076 B2 * 6/2010 Staub ..... E04D 13/076 52/11
7,726,077 B2 * 6/2010 Dowling ..... E04D 13/076 248/48.2
7,743,561 B1 * 6/2010 Frederick ..... E04D 13/064 248/48.1
7,765,742 B2 * 8/2010 Ealer, Sr. ..... E04D 13/076 52/11
7,861,980 B1 * 1/2011 Verbrugge ..... E04D 13/076 248/48.1
7,914,229 B2 * 3/2011 Aubusson ..... E03F 5/06 210/163
8,015,755 B2 9/2011 Miller et al.
8,281,521 B1 * 10/2012 Rasmussen ..... E04D 13/0459 52/409
8,398,032 B2 * 3/2013 Higgins ..... E04D 13/0725 248/48.1
8,579,238 B2 11/2013 Jones
8,683,695 B2 * 4/2014 Rasmussen ..... E04D 13/0459 29/525
8,695,307 B2 * 4/2014 Bissery ..... E04D 3/40 248/237
8,959,840 B1 * 2/2015 Oxley ..... F21V 21/00 210/170.03
9,370,814 B2 * 6/2016 Rasmussen ..... E04D 13/0459
9,556,973 B2 * 1/2017 Rumsey ..... F16L 3/06
9,771,720 B2 * 9/2017 Martin ..... E04D 13/064
2005/0012003 A1 1/2005 Jackson et al.
2006/0037252 A1 * 2/2006 Gosse ..... E04D 13/076 52/11
2006/0179723 A1 8/2006 Robins
2007/0074466 A1 * 4/2007 Rasmussen ..... E04D 13/0459 52/97
2007/0114337 A1 5/2007 Rommelmann, Jr.
2008/0010906 A1 * 1/2008 Brochu ..... E04D 13/076 52/12
2011/0049118 A1 * 3/2011 Nark ..... E04D 13/103 219/213
2011/0147537 A1 6/2011 Ringo, Jr.
2014/0326837 A1 * 11/2014 Rumsey ..... F16L 3/06 248/65
2015/0259924 A1 * 9/2015 Van Biber ..... E04D 13/0459 52/11
2016/0054030 A1 * 2/2016 Ilzhofer ..... F24S 25/632 248/237

* cited by examiner

ROOFING EDGE HANGER FOR DECORATIVE LIGHTS

BACKGROUND

1. Field of Invention

The present invention relates to mountable hanger, and more particularly to roof hangers having hooks for hanging decorative lights.

2. Description of Related Art Including Information Disclosed Under 37 C.F.R. 1.97 and 1.98

Decorative lights typically do not come provided with means for mounting them to display surfaces, such as housing sides. People have used many methods for hanging up decorative lights and other objects from the roof or on the side of their residence. For decorative lights, typically, staples or nails are used. Staples are used to staple the wire strand of the decorative lights to the roof edge or to the side of the residence, and nails are put in place so that the wire strand of the decorative lights wraps around the nails. However, stapling has several potential drawbacks, including damage to the mounting surface, which increases with repeated mounting and dismounting of the decorative lights, and potential damage to the wire strand of the decorative lights. The decorative lights installer is also exposed to injury during the stapling process. Nails also have similar drawbacks as staples. Other accessories used for mounting lights may also break or become brittle and require replacement overtime, and some accessories used for mounting may not provide enough strength to support the weight of the decorative lights or other hanging objects.

It is desirable to have an apparatus and method for mounting decorative lights (and other objects) to a mounting surface, such as a roofing edge, without the need for damaging the surface. It is also desirable for an apparatus and method that can temporarily mounted to a roofing edge so that it can be removed and replaced in case of roofing projects. It is also desirable to have an apparatus and method for mounting decorative lights without the need for other accessories.

BRIEF SUMMARY

A roofing edge hanger for decorative lights is provided. In an exemplary embodiment, the hanger comprises a substantially planar body portion adapted to lie flat against a roof; a first support arm lying on a first plane parallel to the body portion, wherein the first support arm is attached to the body portion; a second support arm lying on a second plane that intersects the first plane at an angle, wherein the second support arm is attached to the first support arm; and a plurality of hooks extending from the first support arm where the plurality of hooks are formed from a plurality of perforations of the first support arm. The hanger is made from a single sheet of metal, and the hanger can be made from a ferrous metal. In some embodiments, the hanger is made from a 26 gauge metal.

In some embodiments, the roof portion and the hook portion of the substantially planar body can comprise substantially equal amounts of area. The roof portion, in another embodiment, can comprise more area than the hook portion.

In another exemplary embodiment, a method for using a roofing edge hanger for decorative lights is provided. The plurality of hooks are perforated from the plurality of perforations of the roofing edge hanger, and then the perforated hooks are shaped to have an arcuate shape. The hanger is then slotted between a roof and shingles on top of the roof until a support arm of the roofing edge hanger contacts an edge of the roof.

In another embodiment, a method for making a roofing edge hanger for decorative lights is disclosed. The method comprises folding a metal sheet along a first score line of the metal sheet at a first 90 degree angle to create a body portion. A second score line of the metal sheet is also folded at a second 90-degree angle to create a first support arm portion connected to the body portion, wherein the first support arm lies on a first plane parallel to a second plane on which the body portion lies. A third score line of the metal sheet is folded at a third angle to create a second support arm portion connected to the body portion, wherein the second support arm lies on a third plane that intersects both the first plane and the second plane and divides the body portion into a roof portion and a hook portion. A plurality of hooks are perforated from a plurality of perforations of the metal sheet, wherein the plurality of perforations are positioned on the first support arm, and the perforated hooks are shaped to have an arcuate shape.

Other aspects, embodiments and features of the invention will become apparent in the following written detailed description and accompanying drawings.

BRIEF DESCRIPTION OF THE DRAWINGS

The present invention will be more fully understood by reference to the following detailed description of the preferred embodiments of the present invention when read in conjunction with the accompanying drawings, wherein.

Figure 1A:
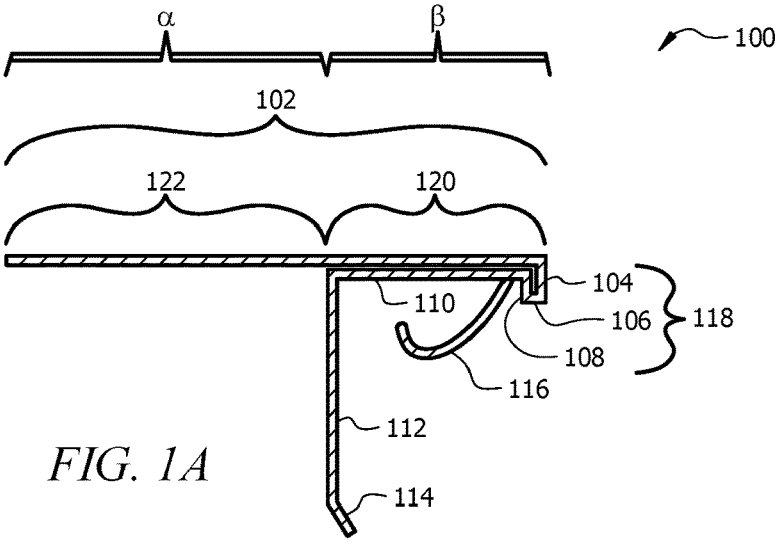
FIG. 1A is a side view of an exemplary embodiment of the roofing edge hanger.

The above figures are provided for the purpose of illustration and description only, and are not intended to define the limits of the disclosed invention. Use of the same reference number in multiple figures is intended to designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the present invention have been read and understood

DETAILED DESCRIPTION

This disclosed principles provide a number of innovations, including novel systems and method for facilitating a unique roofing edge hanger. The hanger and method of using the hanger can be used for hanging decorative lights along the edges of a roof. The hanger and method can also be used with hanging other objects off the edges of a roof. A detailed discussion of the exemplary hanger is provided below; however, it should be understood that the embodiments described herein are only exemplary and do not limit the broader scope of the disclosed principles.

FIG. 1A is a side view of an exemplary embodiment of the roofing edge hanger. The roofing edge hanger 100 provides a mounting surface and hooks 116 upon which decorative lights can be hung or mounted. In the exemplary embodiment, the hanger 100 is made from a single sheet of metal and comprises score lines to designate folds in the hanger material to create the profile of the hanger as shown in FIG. 1A. In other embodiments, the hanger 100 can be made from more than one sheet of metal, and comprises other methods for designating folds in the hanger material to create the profile of the hanger as shown in FIG. 1A. The exemplary hanger 100 is folded along the score lines to create the hanger profile of FIG. 1 A, and hooks 116 can be made from perforations in the hanger 100. The hanger 100 is designed to slot into the space between the roof and the shingles of the roof, so that the force between singles and the roof keeps the hanger 100 in place. The force between the shingles and the roof is also meant to provide enough support to hang objects, such as decorative lights from the edge of the roof.

The exemplary hanger 100 shown in FIG. 1A comprises a substantially planar body portion 102 that folds to form a fringe 118 and support structure underneath the body portion 102. The fringe 118 comprises sides 104, 106, and 108 and is designed to protect the decorative lights from rainfall. The support structure underneath the body portion 102 and the fringe 118 comprises a first support arm 110 and a second support arm 112, and is designed to stop the hanger 100 from sliding past the second support arm 112 and to allow adequate space for hanging decorative lights from the hooks 116 of the hanger 100. The first support arm 110 is parallel to the body portion 102 and connects the second support arm 112 to the fringe 118. The first support arm 110 is adjacent to and abuts the hook portion 122 of the body portion 102. In some embodiments, the first support arm 110 connects directly to the body portion 102 without a fringe between the two portions. In the exemplary embodiment, the fringe 118 acts to divert water away from the hooks 116 and from any objects hanging from the hooks 116.

As mentioned, the second support arm 112 is connected to the first support arm 110, and in the exemplary embodiment, the second support arm 112 is perpendicular to the body portion 102. In some embodiments, the second support arm 112 intersects the body portion 102 at any angle. The hanger 100 can also have a lip 114 connected to the second support arm 112 opposite of the first support arm 110. The lip 114 allows for easy access and removal of the hanger from between the roof and shingles.

Because of its positioning in relation to the body portion 102, the second support arm 112 divides the body portion 102 into a roof portion 122 and a hook portion 120. The roof portion 122 of the body portion 102 comprises the area of the body portion 102 that interacts with the roof and the shingles. In some embodiments, the roof portion 122 can comprise friction grips that facilitate the mounting of the hanger 100 between the roof and the shingles. The hook portion 120 of the body portion 102 comprises the area of the body portion 102 that is juxtaposed to the hooks 116, and in the present exemplary embodiment, provides coverage for the hooks 116 so that the hooks 116 are not exposed to water, specifically rainfall. In some embodiments, the hook portion 120 of the body portion 102 comprises perforations for forming the hooks 116.

The dimensions of the body portion 102, the fringe 118, the first support arm 110, and the second support arm 112 can vary depending on the size of the decorative lights or objects to be hung from the hooks 118. One of ordinary skill in the art would understand how to size the various components of the hanger 100 to support the decorative lights or objects to be hung from the hooks 118.

In the exemplary embodiment, the hooks 116 of the exemplary hanger 100 are formed from perforations on the first support arm 110. The perforations are shaped to allow a user of the hanger to perforate the hooks 116 from the first support arm 110, and can have an elongate shape to easy perforation. After the user punches out the hooks 116 from the perforations on the first support arm 110, the user can shape the hooks 116 to have an arcuate shape as shown in the profile of FIG. 1A. The curvature and size of the hooks 116 can vary based on the decorative lights or objects to be hung. One of ordinary skill in the art would understand how to form perforations in the first support arm 110 so that hooks 116 could be perforated from the perforations.

In some embodiments, the hooks 116 may be perforated and shaped into its arcuate shape during the manufacturing process and before the hanger 100 is provided to the end users. In other embodiments, the hooks 116 may be perforated and shaped into the arcuate shape after the hanger 100 is provided to the end users. In some embodiments, the hanger 100 is provided to the user as a sheet of metal with the necessary perforations and score lines for creating the profile of the hanger 100 of FIG. 1, including perforating the hooks 116 from the metal of the hanger 100 to form the hooks 116. By allowing the end user to form the profile of the hanger 100, space is saved for storage of the hanger 100 and the end user can choose to perforate as many hooks as they need while leaving other hooks in line with the first support arm 110 and unperforated. In other embodiments, the hanger 100 can be shaped into the exemplary profile of FIG. 1 without the hooks, and the end user can pick and choose which hooks 116 to perforate from the first support arm 110.

Figure 1B:
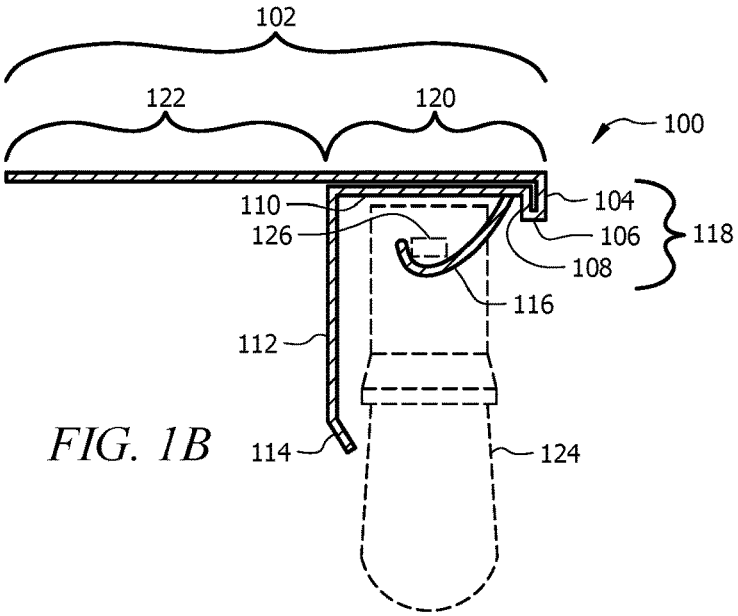
FIG. 1B is a side view of an exemplary embodiment of the roofing edge hanger with a decorative light shown in broken lines.

FIG. 1B is a side view of an exemplary embodiment of the roofing edge hanger 100 with a decorative light shown in broken lines. The hooks 116 are shaped to support decorative lights 124 with the wires 126 connecting the decorative lights 124 resting on the hooks 116. The first support arm 110 provides enough separation between the second support arm 112 and the fringe 118 so that the decorative lights 124 can hang from the hooks 116 without obstructions. The decorative lights 124 can comprise any currently available decorative lights, and in some embodiments, because the hanger 100 is constructed from a ferrous metal, the decorative lights 124 can be attached to a magnetic mount for attachment to the hanger 100 because ferrous metals contain iron and are therefore magnetic. In some embodiments, the hanger 100 is made from a 26 gauge metal.

Figure 1C:
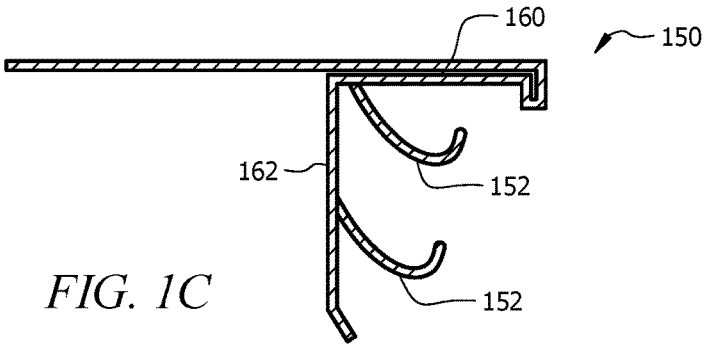
FIG. 1C is a side view of an exemplary embodiment of the roofing edge hanger with hooks angled outward.

FIG. 1C is a side view of an exemplary embodiment of the roofing edge hanger 150 with hooks 152 angled outward. The perforations of the hanger 100 of FIGS. 1A and 1B are positioned so that when the hooks 116 are punched out of the first support arm 110, the hooks 116 are directed towards the second support arm 112. In the exemplary embodiment of FIG. 1C, the perforations of the hanger 150 are positioned so that when the hooks 152 are punched out, the hooks 152 are punched out from the second support arm 162 and are directed away from the second support arm 162. The hooks 152 can be placed on either the first support arm 160 or on the second support arm 162, and can be positioned anywhere along the first support arm 160 or the second support arm 162, as shown in FIGS. 1A-1C.

Figure 2:
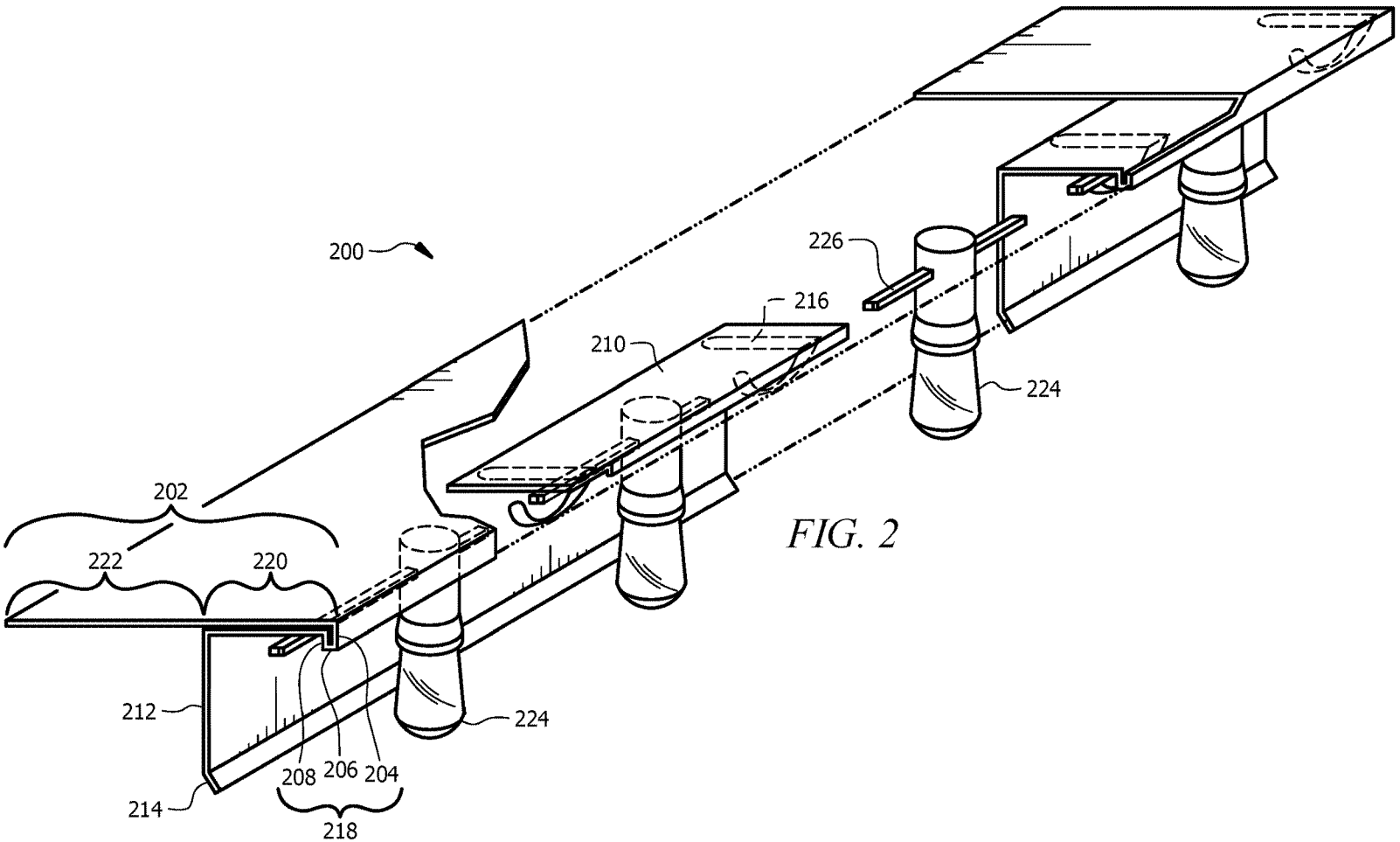
FIG. 2 is an exploded cutaway perspective view of an exemplary embodiment of the roofing edge hanger with decorative lines

FIG. 2 is a cutaway perspective view of an exemplary embodiment of the roofing edge hanger with decorative lights. The cutaways of FIG. 2 are for illustrative purposes and do not limit the scope of the invention. FIG. 2 illustrates the decorative lights 224 hanging from the first support arm 210 of the hanger 200 and how the hooks 216 are positioned and created from perforations of the first support arm 210. FIG. 2 shows the hooks 216 and corresponding perforations in broken lines, and as well as the wire strand 226 of the decorative lights 224 in broken lines when obstructed by the hanger 200. As with the exemplary embodiment of FIG. 1, the present exemplary embodiment of the hanger 200 comprises a body portion 202 connected to a fringe 218 made from sides 204, 206, and 208. The fringe 218, in turn, is connected to the first support arm 210, and the first support arm 210 is connected to the second support arm 212 at an angle. In some embodiments, the second support arm 212 is also connected to a lip 214 for easy access and removal of the hanger 200.

In the exemplary embodiment the body portion 202 of the hanger 200 is substantially planar and is divided by the second support arm 212 into a roof portion 222 and a hook portion 220. The roof portion 222 of the body portion 202 is designed to slot between a roof and shingles, and the hook portion 220 of the body portion 202 is designed to provide coverage for the perforations in the first support arm 210 formed by the creation of the hooks 216. As mentioned previously, other embodiments of the hanger 200 allows for the perforations for the hooks 216 to be positioned on the hook portion 220 of the body portion 202, and the perforations can be positioned on the body portion 202 in locations similar the positioning of the perforations on the first support arm 210 of FIG. 2.

In some embodiments, the first support arm 210 comprises substantially the same amount of area as the hook portion 220 of the body portion 202. As used herein "substantially the same amount" is meant to refer to near equivalent areas of two components, with a variation of no more than 5% in some embodiments. In some embodiments, the hook portion 220 of the body portion 202 and the roof portion 222 of the body portion 202 comprises substantially the same amount of area. In other embodiments, the roof portion 222 of the body portion 202 comprises a larger area than the hook portion 220 of the body portion 202 and a larger area than the first support arm 210.

Figure 3:
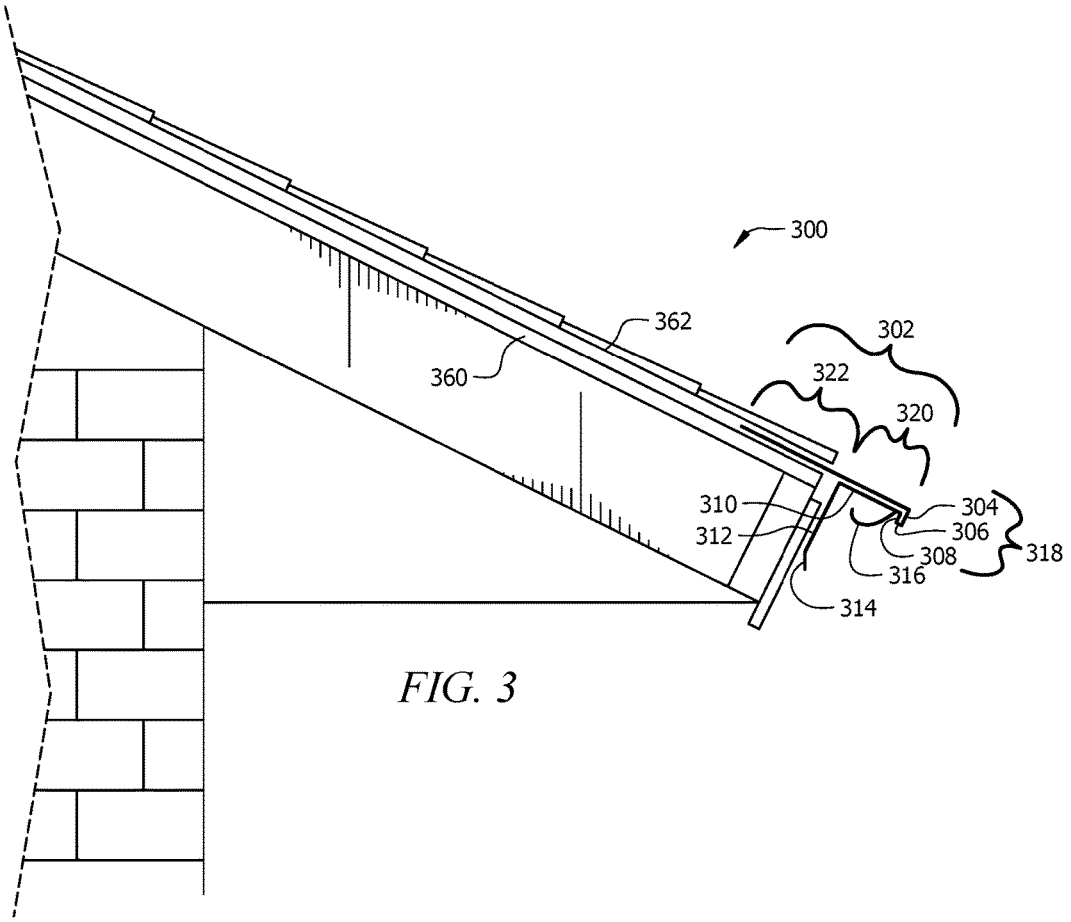
FIG. 3 is an environmental view of an exemplary embodiment of the roofing edge hanger as used on a roofing edge.

FIG. 3 is an environmental view of an exemplary embodiment of the roofing edge hanger 300 as used on a roofing edge. As mentioned previously, the second support arm 312 divides the body portion 302 into two portions: a roof portion 322 and a hook portion 320. The roof portion 322 as shown in FIG. 3 slots between the roof 360 and the shingles 362, and stays in place by the gripping force between the roof 360 and the shingles 362. In some embodiments, the roof portion 322 of the body portion 302 comprises friction grips along the length of the hanger 300, on both the side facing the shingles 362 and the side facing the roof 360, to keep the hanger 300 engaged with the roof 360 and shingles 362.

In the exemplary embodiment, the body portion 302 is slotted in between the roof 360 and the shingles 362 until the second support arm 312 stops the hanger 300 from sliding further. The angling of the second support arm 312 prevents the hanger 300 from sliding past a certain point between the roof 360 and the shingles 362. The second support arm 312 can be angled so that it is perpendicular to the body portion 302, and can also be angled to accommodate the roof edge against which it abuts.

In some embodiments, the hanger 300 comprises a fringe 318 connecting the body portion 302 and the first support arm 310. In case of rain, the fringe 318 diverts the rain away from the decorative lights hung on the hooks 316. The fringe 318 comprises sides 304, 306, 308 and these sides 304, 306, 308 can have any variation of dimensions to create a fringe structure for the hanger 300.

In other exemplary embodiments, the hanger 300 has a lip 314 connected to the second support arm 312 for easy access and easy removal of the hanger 300 from its position between the roof 360 and the shingles 362.

Figure 4:
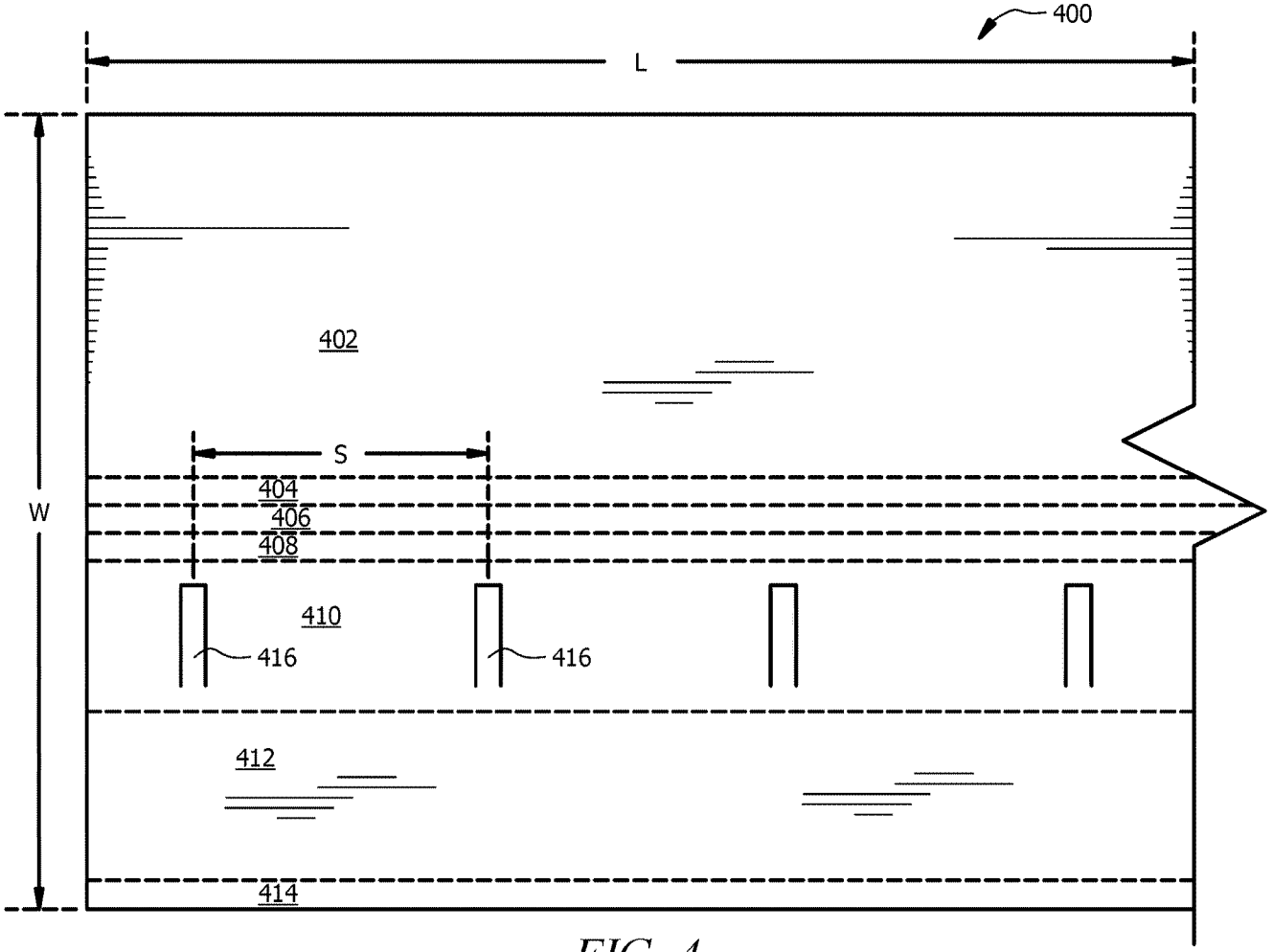
FIG. 4 is a plan view of an exemplary embodiment of the roofing edge hanger.

FIG. 4 is a plan view of an exemplary embodiment of the roofing edge hanger, and illustrates the hanger 400 prior to construction to the form shown in FIGS. 1-3. The hanger 400 can be made from a single sheet of ferrous metal and can comprise score lines as indicated by the broken lines of FIG. 4. The score lines indicated by the broken lines of FIG. 4 separate the various components of the hanger 400: the body portion 402, the fringe formed by 404, 406, and 408, the first support arm 410, and the second support arm 412. One of ordinary skill in the art would understand how to create score lines in the metal sheet, and how to fold along the score lines of the metal sheet.

In the exemplary embodiment as shown in FIG. 4, the hanger has a length denoted by L, and a width denoted by W, which comprises the sum of the widths of the various components of the hanger 400: the body portion 402, the fringe formed by 404, 406, and 408, the first support arm 410, the second support arm 412, and the lip 414. The plan view of the hanger 400 also shows the placement of the perforations for the hooks 416 shown in FIGS. 1-3. The distance between the hooks 416, indicated by "s", can range from 3 to 6 inches depending on the number of hooks 416 and on the length of the hanger 400.

To create the hanger 400 from the metal sheet shown in FIG. 4, the metal sheet is folded along the score line between the body portion 402 and side 404 so the body portion 402 and side 404 are perpendicular to each other. The hanger 400 is folded along the score line between the side 404 and side 406 so that side 404 and 406 are perpendicular to each other and side 406 is parallel to the plane on which the body portion 402 lies. The hanger 400 is also folded along the score line between sides 406 and 408 so that sides 406 and 408 are perpendicular to each other and side 408 is parallel to the plane on which side 404 lies. The hanger 400 is then folded along the score line between side 408 and the first support arm 410 so that the side 408 and the first support arm 410 are perpendicular to each other. At this point, the first support arm 410 abuts the body portion 402 and the fringe has been formed by sides 404, 406, and 408. In some embodiments, the folds of the hanger that create the fringe can be removed so that only side 404 is left and forms the connection between the body portion 402 and the first support arm 410.

The hanger 400 is folded along the score line between the first support arm 410 and the second support arm 412 so that the second support arm 412 lies on a plane that intersects at an the plane on which the first support arm 410. In some embodiments, the angle at which the second support arm 412 intersects the first support arm 410 is a 90-degree angle, and so the first support arm 410 and the second support arm 412 are perpendicular to each other. In other embodiments, the angle between the two can be acute or obtuse and therefore varies based on the size and dimensions of the decorative lights to be hung from the hooks 416. In further exemplary embodiments, the hanger 400 is folded along the score line between the second support arm 412 and the lip 414, so that the plane formed by the lip 414 intersects the plane formed by the second support arm 412 at an obtuse angle to allow for easy access and removal of the hanger 400.

The invention may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. All changes which come within the meaning and range of equivalency of the claims are therefore intended to be embraced therein. Further, the recitation of method steps does not denote a particular sequence for execution of the steps. Such method steps may therefore be performed in a sequence other than recited unless the particular claim expressly states otherwise.

The invention claimed is:

1. A roofing edge for decorative lights, comprising: a roof; and a roofing edge hanger comprising: a bottom of a substantially planar body portion comprising a plane lying flat against the roof;

a first support arm lying on a first plane parallel to the body portion, wherein the first support arm is attached to the body portion;

a second support arm lying on a second plane that intersects the first plane at an angle, wherein the second support arm is attached to the first support arm, wherein the second support arm divides the body portion into a roof portion and a hook portion; and a plurality of hooks extending from the first support arm where the plurality of hooks are formed from a plurality of perforations of the first support arm, wherein a hook portion length of the hook portion is sufficient to allow a plurality of hooks for accommodating the decorative lights, wherein each hook forms a trough in which a wire attached to the decorative lights can rest;

wherein the roofing edge hanger is made from a single sheet of metal.

2. The roofing edge system of claim 1, wherein the roofing edge hanger is made from a ferrous metal.

3. The roofing edge system of claim 1, wherein a roof portion length of the roof portion is substantially equal to the hook portion length of the hook portion.

4. The roofing edge system of claim 1, wherein the roof portion comprises more area than the hook portion.

5. The roofing edge system of claim 1, wherein a first support arm area of the first support arm is substantially equal to hook portion area of the hook portion.

6. The roofing edge system of claim 1, wherein the plurality of hooks are arcuate shaped.

7. The roofing system of claim 1, wherein the body portion of the roofing edge hanger is disposed between a substrate of the roof and a shingle portion of the roof.

8. A method of using a roofing edge hanger for decorative lights, comprising:

perforating a plurality of hooks from a plurality of perforations of the roofing edge hanger, wherein the roofing edge hanger is made from a single sheet of metal, wherein the roofing edge hanger further comprises a parallel support arm, lying on a first plane parallel to the body portion of the roofing edge hanger;

shaping the plurality of perforated hooks to have an arcuate shape;

and slotting a body portion of the roofing edge hanger between a roof and shingles on top of the roof until a support arm of the roofing edge hanger contacts an edge of the roof, wherein the body portion is divided by the support arm into a roof portion and a hook portion, wherein the roof portion is slotted between the roof and the shingles, wherein the roof portion is held in place without the need of penetration of the roof.

9. The method of claim 8, wherein the roofing edge hanger is made from a ferrous metal.

10. The method of claim 8, wherein a roof portion length of the roof portion is substantially equal to a hook portion length of the hook portion.

11. The method of claim 8, wherein the roof portion comprises more area than the hook portion.

12. The method of claim 8, wherein the support arm lies on a second plane that intersects a plane parallel to the body portion of the roofing edge hanger.

13. A method of making a roofing edge hanger for decorative lights, comprising:

folding a metal sheet along a first score line of the metal sheet at a first 90 degree angle to create a body portion;

folding along a second score line of the metal sheet at a second 90-degree angle to create a first support arm portion connected to the body portion, wherein the first support arm lies on a first plane parallel to a second plane on which the body portion lies;

folding along a third score line of the metal sheet at a third angle to create a second support arm portion connected to the body portion, wherein the second support arm lies on a third plane that intersects both the first plane and the second plane and divides the body portion into a roof portion and a hook portion;

perforating a plurality of hooks from a plurality of perforations of the metal sheet, wherein the plurality of perforations are positioned on the first support arm, shaping the plurality of perforated hooks to have an arcuate shape.

14. The method of claim 13, wherein the roofing edge hanger is made from a ferrous metal.

15. The method of claim 13, wherein a roof portion length of the roof portion is substantially equal to a hook portion length of the hook portion.

16. The method of claim 13, wherein the roof portion comprises more area than the hook portion.

* * * * *